United States Patent [19]

Brooks

[11] Patent Number: 4,963,762

[45] **Date of Patent: * Oct. 16, 1990**

[54] EVACUATION CHAIR

[75] Inventor: Royce L. Brooks, Benicia, Calif.

[73] Assignee: Norman D. Koerner, Benicia, Calif.

[ * ] Notice: The portion of the term of this patent subsequent to Dec. 8, 2004 has been disclaimed.

[21] Appl. No.: 112,539

[22] Filed: Oct. 23, 1987

Related U.S. Application Data

[63] Continuation of Ser. No. 750,993, Jul. 2, 1985, Pat. No. 4,711,487, which is a continuation of Ser. No. 349,913, Feb. 18, 1982, abandoned.

[51] Int. Cl.[5] ..... A61G 1/00; A47C 4/00

[52] U.S. Cl. ..... 297/183; 297/39

[58] Field of Search ..... 297/39, 183, 250, 484, 297/DIG. 4, 82; 16/114 R; 224/157; 5/82 R

[56] References Cited

U.S. PATENT DOCUMENTS

| | | | |
|---|---|---|---|
| 263,819 | 9/1882 | Shannon | 5/82 |
| 545,695 | 9/1895 | Jamme | 297/183 |
| 640,293 | 1/1900 | Freuler | 5/82 |
| 865,006 | 9/1907 | Bensinger et al. | 297/183 |
| 1,370,176 | 3/1921 | Wollam et al. | 297/183 |
| 2,392,850 | 1/1946 | Johnson | 5/82 |
| 2,400,155 | 5/1946 | Letschert et al. | 297/183 X |
| 2,503,314 | 4/1950 | Atwood | 5/82 |
| 2,545,813 | 3/1951 | Jackson | 297/183 |
| 2,851,086 | 9/1958 | Weiner | 297/39 |
| 2,906,319 | 9/1959 | Goldstein | 297/39 |
| 2,964,099 | 12/1960 | Panicci | 297/39 X |
| 3,061,365 | 10/1962 | Frieberg | 297/183 |
| 3,151,909 | 10/1964 | Gerdetz | 297/183 |
| 3,279,734 | 10/1966 | Kramer | 297/39 |
| 3,319,997 | 5/1967 | Clement | 297/39 |
| 3,467,033 | 9/1969 | Sienkiewicz et al. | 248/156 |
| 3,934,934 | 1/1976 | Farrell, Jr. et al. | 297/250 |
| 4,711,487 | 12/1987 | Brooks | 297/39 X |

FOREIGN PATENT DOCUMENTS

| | | | |
|---|---|---|---|
| 547406 | 5/1956 | Belgium | 297/39 |
| 302757 | 12/1917 | Fed. Rep. of Germany | 5/82 |
| 1429347 | 11/1962 | Fed. Rep. of Germany | 297/183 |
| 435949 | 11/1911 | France | 5/82 |
| 111650 | 12/1917 | United Kingdom | 5/82 |

*Primary Examiner*—Francis K. Zugel

*Attorney, Agent, or Firm*—Bruce & McCoy

[57] ABSTRACT

A chair secured between parallel carrier arms which extend from the front and back of the chair enables the carrying of a handicapped person by two other people including on staricases or under other conditions where conventional conveyances for the handicapped such as wheel chairs, gurneys, stretchers or the like are unsuitable. The chair is extendable and contractable relative to the carrier arms between an expanded operating configuration and a flat compact storage configuration which makes it practical to stock and prominently display the apparatus in locations such as high rise buildings where it may be needed during emergency evacuations or for other purposes.

2 Claims, 3 Drawing Sheets

EVACUATION CHAIR

This is a continuation of copending application Ser. No. 750,993 filed on 7/2/85 now U.S. Pat. No. 4,711,487, which is a continuation of application Ser. No. 349,913 filed on 2/18/82 now abandoned.

DESCRIPTION

1. Technical Field

This invention relates to devices for manually transporting handicapped persons and more particularly to apparatus for facilitating the carrying of a person by others.

2. Background of the Invention

Carrying of a handicapped person during an emergency evacuation of a building or for other reasons can be very difficult if no equipment for facilitating the task is available.

Conventional conveyances for manually transporting handicapped persons are unsuitable for use under some conditions. Devices which necessarily ride on wheels such as wheel chairs, gurneys or the like are designed for use on unobstructed fairly level surfaces and are not adaptable to travel on stair cases or on rough terrain or along on otherwise travelable surface which may be littered with obstacles from some unusual occurence.

Stretchers are somewhat more adaptable to such conditions but also have serious disadvantages. The person on a stretcher is necessarily in a prone position and additional space must be provided at each end of the stretcher for the carriers. Consequently a stretcher has a length which can create problems in maneuvering around corners, stair landings or in negotiating obstacles. A stretcher should be kept fairly level and this can also be taking to the stretcher bearers. As a practical matter the travel of stretcher bearers on anything other than a fairly level unobstructed surface tends to be slow at best. This can impede movement of other people along constricted passages such as on stairways for example.

At certain periods of past history, persons of high rank were sometimes carried by others in devices known as sedan chairs or palanquins. These included a seat within a cab-like enclosure which was attached to spaced apart carrying poles held by bearers situated both in front of and behind the cab. Such devices, primarily of historical or archeological interest, are far too bulky and cumbersome to be of practical value for the modern purposes described above.

Providing for the manual transport of people during emergencies has recently become a very pressing concern as a result of the widespread construction of new multistory or high rise buildings. Wheel chair ramps and a variety of other design arrangements are being made to make such buildings more accessible to the handicapped. Consequently considerable numbers of handicapped persons may be present in a multistoried building at any given time. There may also be other persons in a building who do not come within the normal definition of the term handicappeded but who may also temporarily unable to walk adequately. Such temporary incapacity may arise from any number of causes such as injury, panic in emergency situations or disabilities brought about by drugs or intoxicants.

Fast evacuation of people from multistoried structures is sometimes necessary because of fire, gas leakage, bomb threats or for any of a number of other reasons. Under some circumstances, of which fire is the most common example, the building elevators may be unavailable for use in evacuating people. Elevator shafts carry flames and smoke upwardly within the building. Persons confined in a closed elevator may be highly exposed to injury or death from smoke inhalation. For these and for a number of other reasons, elevators are returned to the ground floor at the start of the emergency and people are required to use the building staircases as an evacuation route.

Mandatory evacuation procedures also frequently prohibit the use of wheelchairs, stretchers or even crutches on staircases during an emergency evacuation. In addition to the hazard to the handicapped person, attempts to use such devices may slow or block use of the stairs by others. Consequently, it has heretofore been necessary, that handicapped persons be carried down the staircase by one or more other persons during an emergency evacuation. The procedure is very taxing on the persons who must do the carrying and can also be traumatic to the handicapped persons themselves.

The problem is further aggravated by the, practical requirement that the hand carrying of handicapped persons down the staircase during an evacuation be delayed until other persons, who are able to walk down the staircase, have been evacuated. This is a practical necessity since unaided hand carrying of persons is a slow operation which could greatly delay the overall evacuation and thereby increase the hazard to everyone concerned.

Persons who must wait and be the last to evacuate a high rise building in an emergency can be placed under a great deal of stress. It is very undesirable from this standpoint that the handicapped, in particular, must be the ones who are evacuated last. An inability to move about without assistance makes the situation still more stressful for the handicapped than it is for other persons.

For the foregoing reasons, there is a very pressing need for some means for facilitating the manual carrying of persons down the staircases of high rise buildings in emergency situations. Such a device should be compact and also be of an economical construction so that it is practical to stock a number of such devices at different locations in high rise buildings. The device should be adaptable to use by untrained carriers without complications or confusion and it should, to the extent possible under the circumstances, be arranged to lessen the trauma to handicapped persons who are carried on the device.

While the emergency evacuation of high rise buildings is perhaps the most dramatic example of the need for a more versatile device for manually carrying persons, there are other circumstances under which such apparatus can also be useful. Many older buildings do not have facilities to accomodate wheelchairs or the like and thus are not accessible to the handicapped unless they are assisted. Travel in many outdoor locations may involve rough terrain on which the conventional conveyances described above are unsuitable.

The present invention is directed to overcoming one or more of the problems discussed above.

SUMMARY OF THE INVENTION

In one aspect of the present invention the apparatus for manually transporting a handicapped person has a chair and spaced apart carrier arms extending forward and backward from the chair. Means are provided for extending and contracting the chair between an expanded operating configuration and a more compact storage configuration.

The invention enables the transporting of a handicapped person by two or more other persons more easily, more securely and with less discomfort to the handicapped person than is the case where manual carrying must be performed without the aid of equipment for facilitating the task. While not being limited to such usage, the apparatus is particularly adaptable to the carrying of handicapped persons down stairways during a building evacuation. The contractability of the apparatus makes it practical to stock high rise buildings or the like with the devices which may, if desired, be stored in conspicuous locations with identifying instructions which make the purpose of the device and its operation readily apparent to persons who may not be trained in evacuation techniques and procedures.

The invention, together with further objects and advantages thereof, may be further understood by reference to the accompanying drawings and the following description of detailed examples.

DETAILED DESCRIPTION OF PREFERRED EMBODIMENTS OF THE INVENTION

Figures 1, 4, 5:
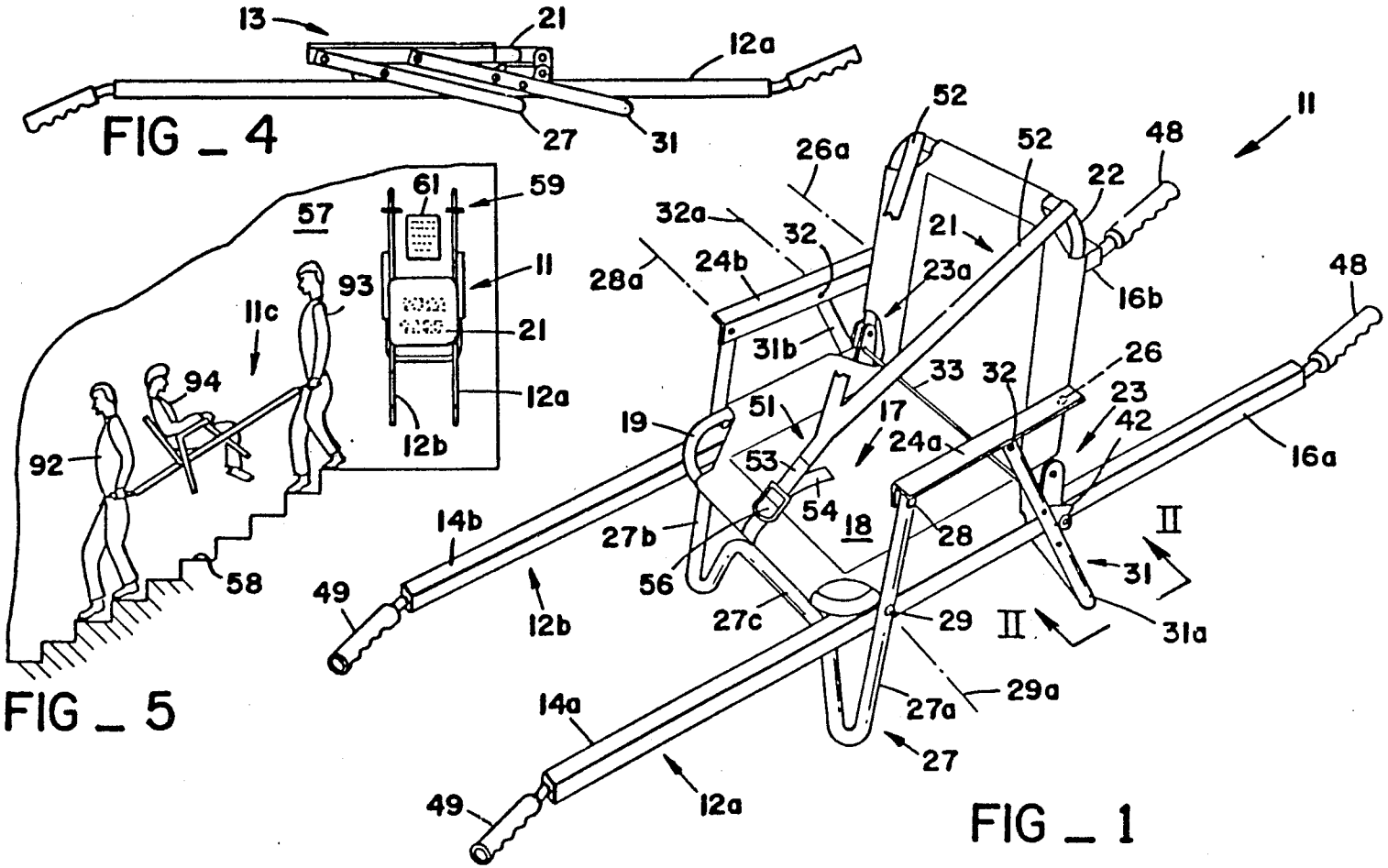
FIG. 1 is a perspective view of a device for manually transporting handicapped persons in accordance with one embodiment of the invention, the devide being depicted in the expanded or operating configuration.
FIG. 4 is a side view of the apparatus of FIG. 1 shown in the contracted or storage configuration.
FIG. 5 is an elevation view depicting the apparatus of FIGS. 1 to 4 in a typical preferred storage and display position in a high rise building and also depicting such apparatus in use.

Referring initially to FIG. 1 of the drawing, apparatus 11 for manually transporting a handicapped person in accordance with a first embodiment of the invention includes a pair of carrier arms 12*a* and 12*b* spaced apart a distance sufficient to allow the persons who will carry the apparatus to fit between the arms. Chair 13 is situated at an intermediate position between the ends of the arms so that a first pair of arm segments 14*a* and 14*b* extend out from the front of the chair while a second pair of arm segments 16*a* and 16*b* extend out from the back of the chair.

The chair 13 in this example has a seat 17 which may be formed of fabric 18 stitched to a U-shaped tubular metal frame 19 that defines the front and sides of the seat and which is secured to the mid-sections of the carrier arms 12*a* and 12*b*.

The chair 13 is further provided with a back support 21 which is formed of another portion of the fabric 18 stitched to another U-shaped tubular metal frame 22 that defines the sides and top of the back support. Frame 22 is connected to the carrier arms 12*a* and 12*b* through pivot and linkage means 23 to be hereinafter described in more detail.

One of a pair of arm rests or side members 24*a* and 24*b* extends from each side of back support 21 towards the front of the chair in parallel relationship with the carrier arms 12*a* and 12*b*. Each such side member 24*a* and 24*b* is coupled to back support frame member 22 through a pivot connection 26 that enables pivoting movement of the side member relative to the back support about a transverse horizontal pivot axis 26*a* extending in the plane of the back support and which is spaced above the seat 17 and below the top of the back support.

A front leg member 27 which may be formed of a single length of tubular metal has front leg segments 27*a* and 27*b* at opposite sides that extend down and towards the front of the chair 13 from the front end of side members 24*a* and 24*b* respectively. Front leg segments 27*a* and 27*b* extend below the carrier arms 12*a* and 12*b* to support the seat 17 at a suitably elevated position when the chair 13 is rested on an underlying surface. The lower ends of the leg segments 27*a* and 27*b* are connected by the intermediate portion 27*c* of the front leg member 27 which portion is upwardly arched to provide leg space for a person in the chair and in order not to interfere with the leg motions of persons who carry the apparatus.

The upper ends of front leg segments 27*a* and 27*b* are connected to the front ends of side members 24*a* and 24*b* respectively by additional pivot connections 28 which enables pivoting motion of the leg member 27 relative to the side members 24 about a pivot axis 28*a* which is parallel to the previously described pivot axis 26*a* and spaced the same distance above the seat 17. Additional pivot connections 29 couple the leg segments 27*a* and 27*b* to frame 19 of seat 17 for pivoting movement about still another transverse pivot axis 29*a* which is parallel to axis 28*a* and situated within the plane of the seat 17.

A back leg member 31 has a configuration similar to that of the front leg member 27 and includes back leg segments 31*a* and 31*b* with upper ends connected to side members 24*a* and 24*b* respectively by additional pivot connections 32. Pivot connections 32 are situated at an intermediate location along side members 24*a* and 24*b* and define a pivot axis 32*a* which is parallel to and coplanar with pivot axes 26*a* and 28*a*.

The back leg segments 31*a* and 31*b* extend downward and backward from pivot connections 32, the inclination of the back leg member 31 being slightly greater than that of the front leg member 27 so that the front of the seat 17 is somewhat higher than the back of the seat when the chair 13 is rested on the underlying surface.

A rod 33 extends transversely at the juncture between the back of the seat 17 and the lower edge of the back support 21 immediately in front and above the bend of the fabric 18 of the seat and back support. Pivot and linkage means 23 inter-connect the rod 33, seat 17, back support 21 and back leg member 31 as depicted in more detail in FIGS. 2 and 3.

Figure 3:
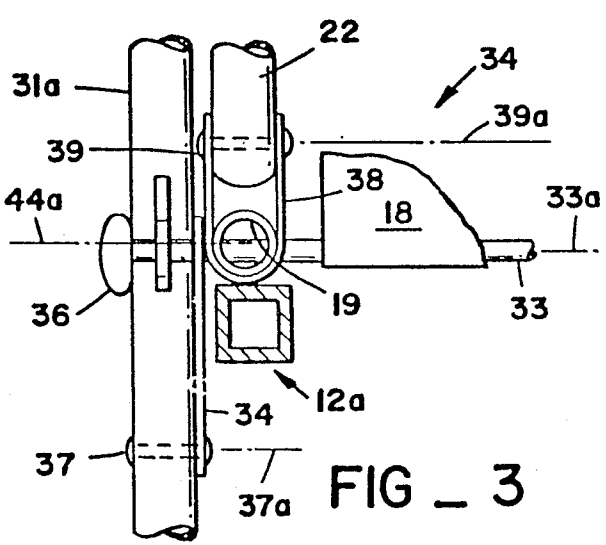
FIG. 3 an end view of the structure depicted in FIG. 2 taken along line III—III thereof.
Figure 2:
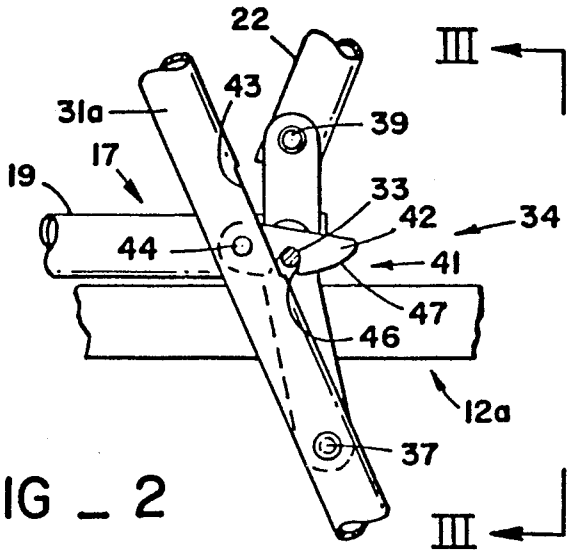
FIG. 2 is a side elevation view of a portion of the device of FIG. 1 taken along line II—II thereof.

Referring now to FIGS. 2 and 3 in conjunction, at each side of chair 13 rod 33 extends through the back end of seat frame member 19, through the upper end of a pivot link 34 and then outward behind the adjacent back leg segment 31*a* to a rod end cap 36.

Link 34 extends downward from rod 33 and another pivot coupling 37 connects back leg segment 31*a* with the lower end of the link to provide for pivoting movement of the link and leg segments relative to each other about still another pivot axis 37*a* which is parallel to the axis 33*a* of rod 33 but spaced downward and slightly backward from axis 33*a*. The lower end of a U-shaped bracket 38 extends around seat frame member 19 above carrier arm 12*a* and upward from the seat frame member a short distance to couple to the lower end of back support frame member 22 at still another pivot coupling 39. The pivot axis 39*a* of coupling 39 is parallel to rod 33 and is situated a short distance directly above the rod.

Latching means 41 are provided for locking all of the above described components of the chair 13 in the expanded or operating configuration, the latching means being disengageable to enable folding or contracting of the chair components into a more compact storage configuration as will hereinafter be described in more detail. In this example the latching means 41 includes a pivotable latch member 42 having an end which extends into a slot 43 in back leg segment 31*a* and which is coupled to the leg segment by another pivot coupling 44. Coupling 44 enables pivoting of the latch member 42 about another pivot axis 44*a* which is parallel to rod 33 and a small distance above the rod in front of U-bracket 38. When the chair 13 is in the expanded or operating configuration, a notch 46 in the underside of the latch member 42 engages on rod 33 and thereby locks all of the pivotable elements of the chair in fixed relationship to each other. The chair 13 may be unlatched for folding to the compact storage position by swinging the latch member 42 upward to disengage notch 46 from rod 33. The under surface 47 of latch member 42 slants upwardly toward the back end so that the latch member rides upwardly on rod 33 as back leg segment 31*a* is pivoted towards the operating position and then drops and latches automatically when the notch 36 reaches rod 33.

Referring again to FIG. 1, similar pivot and linkage means 23*a* are provided at the opposite side of the chair 13.

One of a first pair of hand grips 48 is secured to the outermost end of carrier arm segments 16*a* and one of a second pair of hand grips 49 is secured to the outer end of each of the other carrier arm segment 14*a* and 14*b*. Where, as in the present example, the carrying apparatus 11 is to be used primarily for transporting handicapped persons down stairways, the first pair of hand grips 48 are angled upwardly relative to the associated carrier arm segments 16*a* and 16*b* while the second pair of hand grips 49 are angled downwardly relative to carrier arm segments 14*a* and 14*b*.

Means 51 are provided for securing a person to be carried in the chair 13. In this example, a pair of shoulder straps 52 are attached to the upper corners of the back support frame member 22 and converge at the opposite ends into a single strap 53. An additional strap 54 has one end secured to the forward portion of seat 17 at the center. In use, straps 52 extend over the handicapped person's shoulders while straps 53 and 54 are secured together between the persons legs by releasable buckle structure 56 attached to the straps.

The chair 11 may be folded or contracted into a more compact storage configuration by initially lifting the free ends of the latch members 42 to disengage the latch members from rod 33. Back support 21 may then be swung forward and downward until it is parallel to and adjacent seat 17 as depicted in FIG. 4. This movement also swings leg members 27 and 31 upwardly into contact with the underside of carrier arms 12*a* and 12*b*. The size of the chair 13, in a direction normal to the plane of the carrier arms 12*a* and 12*b*, is then greatly reduced.

The capability of contracting the apparatus 11 into the compact storage position depicted in FIG. 4 makes it practical to store one or more units of the apparatus in at locations in buildings where it is visible to persons who may need to make use of it. For example, as depicted in FIG. 5, the carrier apparatus 11 may be suspended against a wall 57 in the vicinity of a stair case 58 by means of suitable hooks or clamps 59. Printed instructions 61 may be posted on the wall 57 preferably between the carrier arms 12*a* and 12*b*. The back surface of back support 21, which is visible to passer bys, is preferably provided with a legend, such as "evacuation chair" or the like which is suggestive of the purpose of the device. The configuration of the apparatus 11 itself tends to make its purpose apparent to persons in the vicinity and this quick recognition is aided by a descriptive legend and further by locating the apparatus at a site of potential use such as near the head of a stair case as described above.

Figure 6:
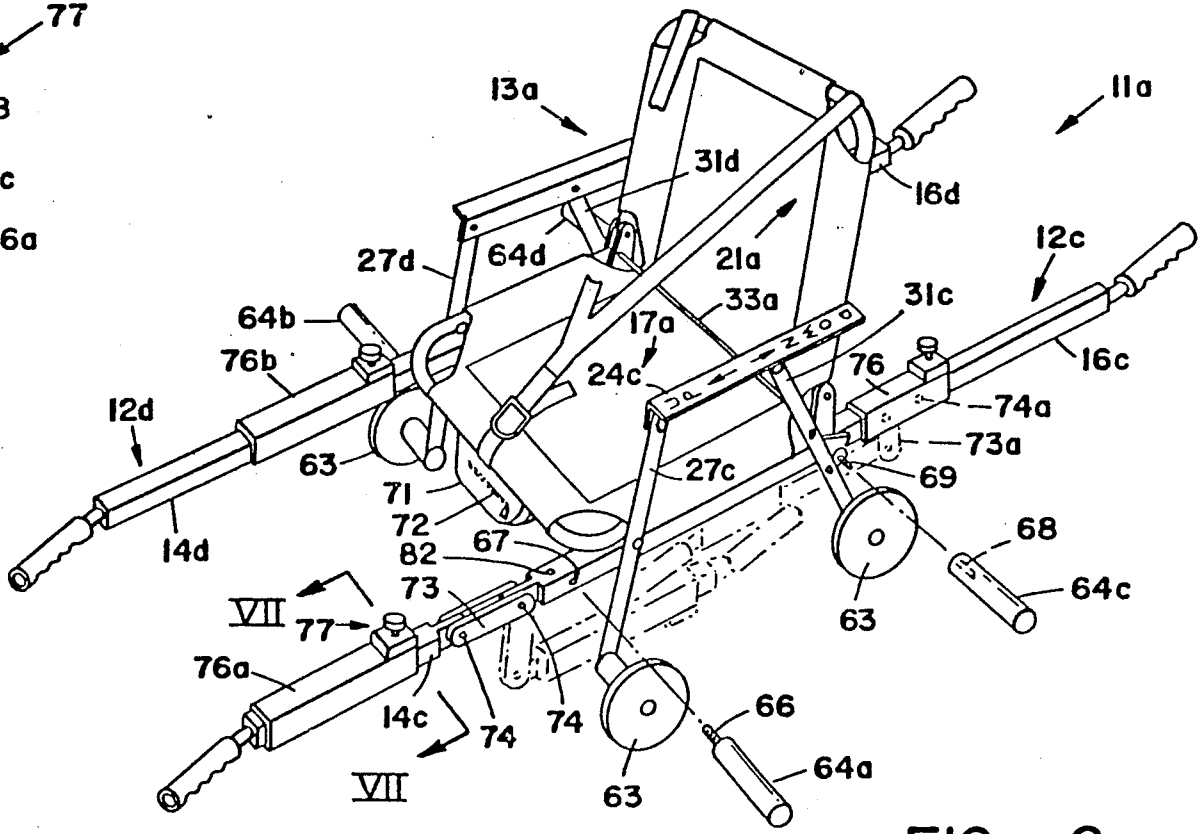
FIG. 6 is a perspective view illustrating a second embodiment of the apparatus which includes modifications and additional components for facilitating certain particular types of use of the apparatus.

A variety of structural modifications may be made and additional components added to facilitate certain specific forms of usage. A second embodiment of the carrier apparatus 11*a* which includes such modifications is depicted in FIG. 6. In the embodiment of FIG. 6, the front leg segments 27*c* and 27*d* of the chair 13*a* are separate elements rather than being parts of a single leg member as in the of the leg segments are relatively short. A rotatable wheel 63 is mounted on the lower, end of each such leg segment 27*c* and 27*d*. The rear leg segments 31*c* and 31*d* have a similar construction and are also provided with wheels 63. Wheels 63 enable the carrier apparatus 11*a* to be put down on a flat surface such as a stair landing so that the load may be rolled rather than carried to the extent that it is possible. By mounting the wheels 63 further out from the front leg segments 27*c* and 27*d* than is the case with the wheels of the rear leg segments 31*c* and 31*d*, interference between the wheels is avoided when the chair 13*a* is folded to the compact storage configuration.

The carrier apparatus 11*a* of FIG. 6 is also provided with supplemental carrying handles 64 which extend outward from the carrier arms 12*c* and 12*d* to enable additional persons to assist with the carrying. In this example, a first pair of supplemental carrier handles 64*a* and 64*b* extend sidewardly from carrier arms 12*c* and 12*d* respectively adjacent the front edge of the seat 17*a* while a second pair of supplemental carrier handles 64*c* and 64*d* extend out from carrier arms 12*c* and 12*d* respectively below the back support 21*a*.

It is preferable that the supplemental carrier handles 64 be easily removable from the carrying arms 12*c* and 12*d* so that the carrier apparatus 11 may be more easily maneuvered through very constricted passageways where such handles might otherwise catch on adjacent structures such as banister posts for example. In this embodiment the front pair of supplemental carrier handles 64*a* and 64*b* have a threaded stud 66 at the end which engages in a threaded bore 67 in the carrier arms 12*c* or 12*d* and may be easily removed when necessary by being rotated. The rear supplemental carrier handles 64c and 64d have threaded axially directed bores 68 in one end which engage with a threaded extension 69 at each end of the rod member 33a of the chair 13a.

The embodiment of FIG. 6 also includes means for carrying medical equipment or other articles, such as an oxygen supply, which may be needed by the person being carried. In this example a fabric pouch 71 with a zipper closure 72 is attached to the underside of seat 17a for this purpose, although a rigid framed compartment may also be provided without greatly increasing the bulk of the apparatus in the folded or storage position.

Figure 7:
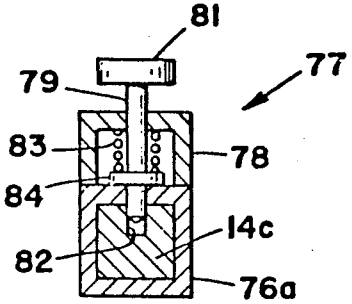
FIG. 7 is a cross section view of a portion of the apparatus of FIG. 6 taken along line VII—VII thereof.

In some forms of use it may be desirable to render the carrier apparatus 11a still more compact when in the storage configuration. This may, for example, facilitate the transporting of the carrier apparatus 11a in an automobile or the like. In the embodiment of FIG. 6, the carrier arms 12c and 12d have an articulated construction which enables the extremities of the arms to be folded under the seat 17a of the chair 13a. In particular, portions of the carrier arm segments 14c and 14d which extend from the front of the chair are formed by parallel links 73 which are coupled to the adjacent portions of the carrier arm segment through pivot couplings 74 at each end of the links. This enables the outer portion of the carrier arm segments 14c and 14d to be folded down and under seat 17a when the apparatus 11a is not in use. The carrier arms segments 14c and 14d are prevented from folding, when in use, by sleeve members 76 which are slidable along the carrier arm segments between a locking position at which the sleeve members bridge the links 73 and pivot couplings 74 as depicted at 76b and an unlocked position depicted at 76a at which the sleeve members do not prevent folding of the carrier arms at pivot couplings 74. Detent mechanism 77 is provided on each such sleeve member 76a and 76b to assure that the sleeve member remains at the selected position except when it is to be shifted. As depicted in FIG. 7, the detent mechanism 77 may, for example, include a small housing 78 secured to the top of the slidable sleeve member 76a. A vertically directed pin 79 having a knob 81 at the top extends down into housing 78 through the upper portion of sleeve member 76a and into a bore 82 in carrier arm segment 14c which is located under the pin when the sleeve member 76a is at the locking position described above. A spring 83 within housing 78 acts against the flange 84 on the pin 79 to hold the pin in bore 82 except when it is deliberately withdrawn by pulling upward on knob 81.

The other carrier arm segments 16c and 16d which extend outward from the back of chair 13a may also be provided with links 73a, pivot couplings 74a and slidable sleeve members 76b in essentially the same manner to enable such carrier arm segments to be folded under the seat 17a. The spacing between the pivot couplings 74a and thus the length of the links 73a is smaller than in the case of the corresponding elements at the front of the chair 13a so that the two pairs of carrier arm segments may be overlapped when in the folded position.

Figure 8:
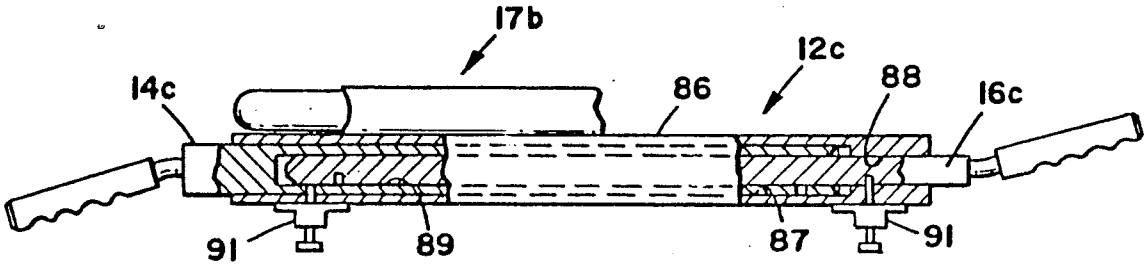
FIG. 8 is a side elevation view of a portion of another embodiment of the invention with means for contracting the apparatus to a still more compact storage configuration.

Other structural arrangements may be made for reducing the length of the carrier arms 12a and 12b when the apparatus in the contracted storage configuration. As depicted in FIG. 8, the carrier arms 12e may, for example, have a telescoping construction. In this modification, the central portion 86 of the carrier arm 12e, located beneath seat 17b, has a longitudinal passage 87 into which the front carrier arm segment 14c may be retracted when not in use. A short back section 88 of the passage 87 is of reduced size relative to the more forward part of the passage and the back carrier arm segment 16c which has smaller transverse dimensions than the front carrier arm segment, extends into the passage section 88. Front carrier arm segment 13c has an internal passage 89 sized to receive the back carrier arm segment 16c. Thus, when the apparatus 11 is not in use, the back carrier arm 16c may also be retracted into the central portion 86 of the carrier arm 12b. Detent mechanisms 91 of the form previously described may be provided at the front and back ends of carrier arm portion 86 to lock the carrier arm segments 14c and 16c at both of the extended and retracted positions.

OPERATION

During storage the carrier apparatus 11 is in the folded or contracted configuration depicted in FIG. 4 and, where it is intended for emergency use in the evacuation of a multistory building, it is preferably disposed flat against a wall as depicted in FIG. 5 at a location where it will be conspicuous in the event of need.

The carrier apparatus 11 can quickly be prepared for use simply by removing it from the wall 57 and then swinging the top of back support 21 away from the carrier arms 12a and 12b. Such movement pivots side members 26 which in turn pivot leg members 27 and 31 to the operating position or configuration depicted in FIG. 1. The final portion of such movement causes latch members 42 to automatically engage on rod 33 thereby locking the chair 13a in the expanded or operating configuration depicted in FIG. 1.

The handicapped person to be carried is then seated in the chair 13a and straps 52 are then placed over the person's shoulder. Strap 54 is drawn up between the person's legs and engaged to strap 53 with buckle 56.

To avoid misunderstanding, the terms "front" and "back" have herein been used with reference to the chair 13 and other portions of the carrier apparatus 11 in the same sense that such words are normally understood with reference to a chair. In the mode of usage for which the apparatus was primarily designed, specifically for use in descending a stair case, the apparatus is carried with the chair and thus the person in the chair facing backwardly as depicted in FIG. 5. A first carrier person stands between the carrier arm segments 16a and 16b facing forwardly away from the chair 13a and holds one of the hand grips 48 in each hand. The following carrier person 87 similarly stands between carrier arm segments 14a and 14b, facing the front of the chair and holds one of the hand grips 48 in each hand. The previously described opposite inclinations of the hand grips 48 and 49 enable the carriers 86 and 87 to obtain a more secure, less tiring and more comfortable grip on the apparatus 11c when traveling downward in this manner.

If the handicapped person is to be carried up a staircase 58 or other inclined surface, the orientation of the carrier apparatus 11c remains the same, that is the chair 13a and the person 94 who is being carried continue to face upwardly but the carrier persons 92 and 93 turn and face in opposite directions relative to the downstairs mode of travel as depicted in FIG. 5. While the chair 13a may be faced in either direction during travel on a level surface, the carried person may prefer to face forwardly at such times in the manner described above for upstairs travel.

To assure that carrier persons align the apparatus in the proper manner for downstairs travel or upstairs travel, it is desirable that a clear indication of the proper directions for both situations be provided at some highly visible point on the apparatus. For example as depicted in FIG. 6 the words "up" and "down" may be printed on one of the side members 24c with the letters for-the two words running in opposite directions and with adjacent indicator arrows to make the proper direction of travel evident to one or the other of the carrier persons at all times during the use of the apparatus.

Operation of the embodiment of the invention depicted in FIG. 6 is essentially similar to that described above with respect to the first embodiment except insofar as the embodiment of FIG. 6 may be lowered and rolled along a flat surface when one is available along the evacuation route. Supplemental carrier handle 64 also enable the carrier persons to manipulate the carrier apparatus 11*a* while standing at opposite sides of the chair 13*a* in situations where that is necessary or more convenient and also enable additional carrier persons standing at the sides of the chair 13*a* to assist in the carrying operation. When the embodiment shown in FIG. 6 is not in use, the extremities of the carrier arms 12*c* and 12*d* may be folded under the seat 17*a* in the manner previously described thereby substantially reducing the size of the apparatus so that it can be stored in a smaller space or more readily to be transported in an automobile or the like.

While the invention has been described with respect to certain specific embodiments for purposes of example, it is not intended to limit the invention except as defined in the following claims.

I claim:

1. An evacuation chair for manually transporting a handicapped person in a seated position, comprising a chair having seat and back and leg portions, a pair of elongated straight carrier members mounted on opposite sides of and secured to the seat of said chair and extending forwardly and rearwardly therefrom along parallel singular axes, manually graspable handle means formed on the ends of said carrier members including a pair of hand grips secured to and extending longitudinally downwardly from the forward ends of said carrier members at an angle to said carrier members in excess of ten degrees and a pair of hand grips secured to and extending longitudinally upwardly from the rearward ends of said carrier members at an angle to said carrier members in excess of ten degrees, said leg portions including forward and rearward pairs of legs and being pivotally attached to said carrier members, said pairs of legs extending upwardly past the seat portion of said chair with the upper ends thereof forming front and rear arm support portions joined to arm rests, rotatable ground engaging wheels mounted on the lower ends of said rear pair of legs, articulation means formed for permitting simultaneous folding of said seat and chair back and arm rest and arm support portions and said leg portions from operating to collapsed positions flat adjacent to said carrier members, said articulation means being effected by pivotal attachment of said forward and rearward pairs of legs to said carrier members and pivotal attachment of said arm rests to the upper ends of said arm support portions and to said back portion, and latch means disposed proximate the intersections of said chair back and rear arm support portions and said carrier members formed for releasably holding said chair back and said leg portions in operating position.

2. An evacuation chair for manually transporting a handicapped person in a seated position, comprising a chair having seat and back and leg portions, a pair of elongated straight carrier members mounted on opposite sides of and secured to said chair and extending forwardly and rearwardly therefrom along parallel singular axes, said carrier members being spaced apart by a distance sufficient for persons carrying said evacuation chair to stand therebetween, manually graspable handle means formed on the ends of said carrier members including a pair of hand grips secured to and extending longitudinally downwardly from the forward ends of said carrier members at an angle to said carrier members in excess of ten degrees and a pair of hand grips secured to and extending longitudinally upwardly from the rearward ends of said carrier members at an angle to said carrier members in excess of ten degrees, said manually graspable handle means also including pairs of supplementary hand grips removably securable in openings in said carrier members adjacent to the front and the rear of said seat portion so as to project laterally from said seat portion;

said leg portions including forward and rearward pairs of legs and being pivotally attached to said carrier members, said pairs of legs extending upwardly past the seat portion of said chair with the upper ends thereof forming front and rear arm support portions joined to arm rests, articulation means formed for permitting simultaneous folding of said chair back and arm rest and arm support portions and said leg portions from operating to collapsed positions flat adjacent to said carrier members, said articulation means being effected by pivotal attachment of said forward and rearward pairs of legs to said carrier members and pivotal attachment of said arm rests to the upper ends of said arm support portions and to said back portion, and latch means integrated to said articulation means and formed for releasably holding said chair back and said leg portions in operating position.

* * * * *